United States Patent [19]

Longerot

[11] Patent Number: 4,837,962

[45] Date of Patent: Jun. 13, 1989

[54] SHOTGUN CHOKE CONTAINER/WRENCH

[76] Inventor: Raymond E. Longerot, 5785 Equador Way, Buena Park, Calif. 90620

[21] Appl. No.: 210,818

[22] Filed: Jun. 21, 1988

[51] Int. Cl.[4] ..... F41C 27/00

[52] U.S. Cl. ..... 42/90

[58] Field of Search ..... 42/79, 90, 106

[56] References Cited

U.S. PATENT DOCUMENTS

| | | | |
|---|---|---|---|
| 688,227 | 12/1901 | Cory | 42/79 |
| 4,602,449 | 7/1986 | Holmes | 42/49.02 |
| 4,736,540 | 4/1988 | Holmes | 42/90 |

*Primary Examiner*—Charles T. Jordan

*Attorney, Agent, or Firm*—William L. Chapin

[57] ABSTRACT

An implement combining the functions of a container for storing and transporting tubular interchangeable shotgun chokes, and installing and removing them, is disclosed. The implement includes a hollow cylindrical tube adapted to hold one or more chokes end-to-end. The tube has an externally threaded open end, closable by a thread cap which may be unscrewed to permit inserting or removing a choke from the tube. The opposite end of the tube is closed by a flanged cylindrical boss having a coaxially rearwardly projecting cylindrical body of smaller diameter than the outer diameter of the tube. A castellated ring fitted coaxially over the body of the boss has four axially rearward projecting lugs spaced apart circumferentially at ninety-degree intervals. The common rear annular transverse surface of the lugs is located in a plane forward of the rear transverse wall of the boss. The lugs are adapted to engage the slots in the front annular transverse wall of a shotgun choke, the inner coaxial boss section serving as a pilot to aid the insertion of the lugs into the slots, thereby facilitating the use of the rear end of the implement as a spanner wrench.

10 Claims, 2 Drawing Sheets

FIG. 4
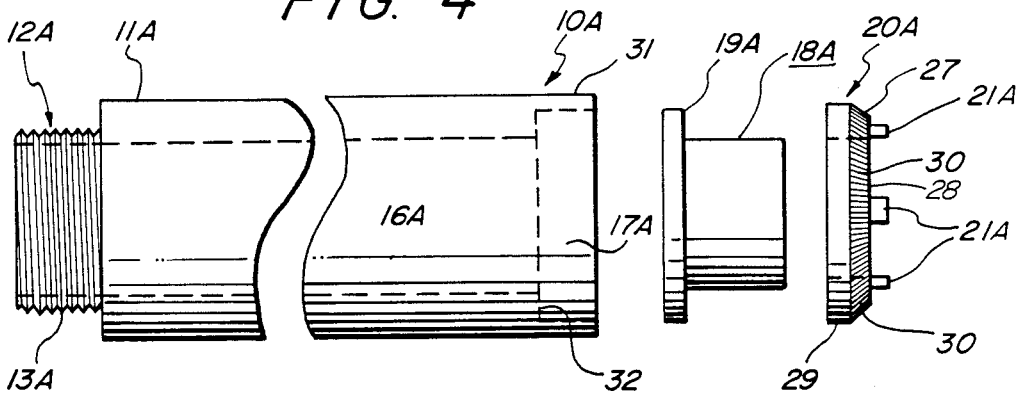
FIG. 5
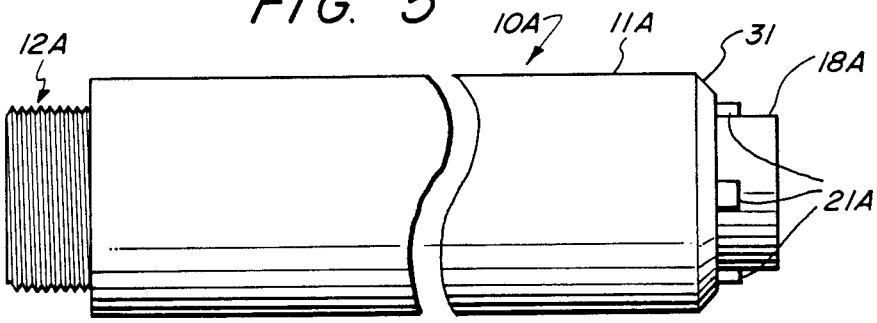
FIG. 6
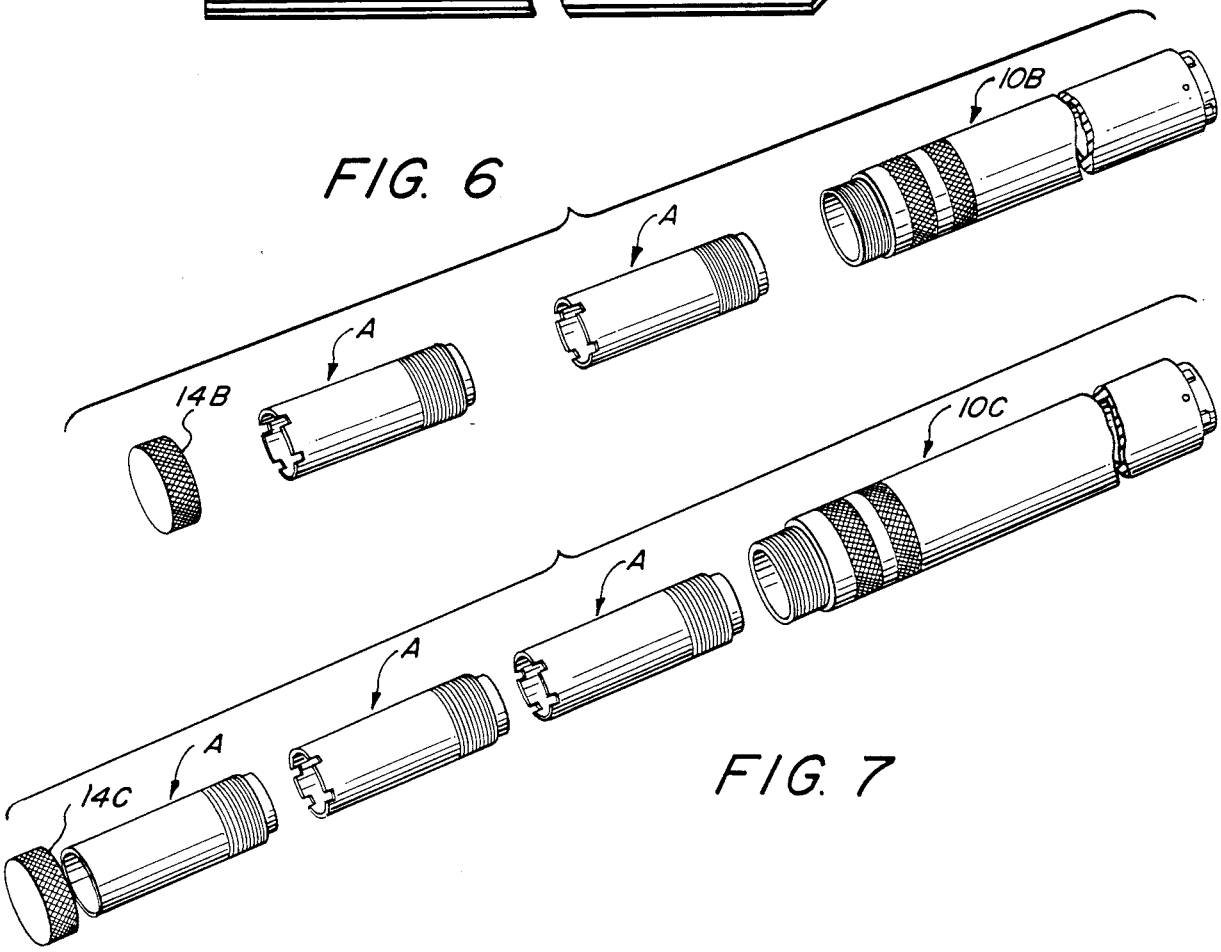
FIG. 7

SHOTGUN CHOKE CONTAINER/WRENCH

BACKGROUND OF THE INVENTION

1. Field of the Invention

This invention relates to accessories for use with shotguns. More particularly the invention relates to an accessory for containing and transporting one or more shotgun chokes which may also be used to install or remove a selected choke from the barrel of a shotgun.

2. Description of Background Art

Shotguns used for skeet and trap shooting, and for taking various types of game, require a somewhat different shot dispersal pattern depending on the particular application. For a given shotgun, the dispersal pattern may be controlled somewhat by using a particular internal diameter bore at the muzzle of the gun. Thus, if the bore near the muzzle of the shotgun tapers to a somewhat smaller diameter than the bore near the breech of the gun, shot expelled from an exploding cartridge will be constrained to exit the muzzle of the gun in a cylindrical column of lesser diameter than would be the case were the muzzle bore not tapered. Therefore, the shot will impact the target in a smaller diameter circle than would be achieved using a shotgun with a lesser reduction in the diameter of the bore in traveling from the breech to the muzzle of the gun.

The construction, or reduction of diameter, of the muzzle bore of a shotgun is referred to as "choking." A shotgun which has a substantial reduction in the diameter of the muzzle bore as compared to the diameter of the bore at the breech end containing the cartridge is said to have a "full choke." Progressively lesser degrees of muzzle bore diameter reduction are referred to as "modified choke," "improved cylinder choke," and the like.

Oftentimes, a sportsman has a favorite shotgun which he would like to use for different applications, such as trap or skeet shooting, or hunting various types of game. Shotguns used for each of these applications has an optimum choke configuration, which is frequently different for each application. In recognition of the requirement of a different optimal shotgun barrel choke for different applications, gun manufacturers have made available shotguns which have replaceable chokes.

The most commonly employed construction providing choke interchangeability includes counterboring the muzzle bore a slight distance inwards, about 2½ inches, for example, from the muzzle of the shotgun barrel. An annular ridge is thus formed at the bottom, or inner end of the counterbore. Beginning a slight distance forward from the annular ridge, a portion of the inner cylindrical wall surface of the counterbored hole is threaded with a helical thread. The barrel end thus modified is adapted to receive replaceable chokes, as will now be described.

Interchangeable chokes which may be used with the shotgun barrel as described above each consist of a short, thin-walled cylinder about 2½" long, made of hardened steel. The outer cylindrical wall surface near one end of the tube has fine helical threads which are adapted to engage the threads in the inner wall surface of the muzzle of the gun barrel.

In most interchangeable chokes, the outer annular end wall of the tube contains rectangular slots cut longitudinally inwards from the outer face of the wall. The slots are provided for engagement by the protruding lugs of a spanner wrench used to install or remove the choke. At least one pair of such slots located at diametrically opposed locations in the outer annular end wall of the choke is provided. Usually, however, four slots at ninety-degree spaced apart positions are provided.

One type of detachable choke and associated wishbone-shaped spanner wrench is disclosed in Cory, U.S. Pat. No. 688,227, Dec. 3, 1901, *Detachable Choke Piece.*

Interchangeable shotgun chokes of the type described above are made of thin-walled steel tubing and are relatively durable. However, the helical threads on the exterior surface of the choke tube are quite fine, and relatively easily damaged. Also, even small nicks or dents in the tubing surface could make the choke difficult to install or remove, and could also adversely affect the dispersion pattern of shot propelled through the choke. Accordingly, it would be desirable to provide a durable protective container for one or more shotgun chokes in which the chokes may be safely carried to a field installation location, while protecting the chokes from inadvertent denting or nicking. In addition, it would be desirable to provide a wrench for installing and removing shotgun chokes which is easy to use and convenient to carry to a field location. With these considerations in mind, the novel combination of a choke installation wrench and container according to the present invention was conceived of.

OBJECTS OF THE INVENTION

An object of the present invention is to provide a spanner-type wrench for installing and removing shotgun chokes which is compact and easy to use.

Another object of the invention is to provide a shotgun choke wrench which includes an integral closable container for safely storing and transporting one or more chokes.

Another object of the invention is to provide a combined shotgun choke wrench and container which may be easily and safely carried on the person.

Another object of the invention is to provide means for storing shotgun chokes in an orderly fashion, thus minimizing the possibility of attempting to install a choke in a gun Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiment. Accordingly, I do not intend that the scope of my exclusive rights and privileges in the invention be limited to details of the embodiment described. I do intend that reasonably inferrable equivalents, adaptations and modifications of the invention described herein be included within the scope of the invention as defined by the appended claims.

SUMMARY OF THE INVENTION

Briefly stated, the present invention comprehends an accessory implement for use with interchangeable shotgun chokes. The implement includes a hollow cylindrical tubular container having an open end closable with a removable threaded cap. The inner diameter of the tube is just slightly larger than the outer diameter of the elongated tubular shotgun chokes which are to be contained within the container. The length of the hollow cylindrical space within the container is of the appropriate value to hold a single choke, or two or three chokes end to end, respectively.

One end of the container tube is closed. Attached to this end of the tube is a cylindrical boss of smaller diameter than the inner diameter of the shotgun choke tube. The boss is coaxially aligned with the tube and projects axially outwards from the bottom disc-shaped wall of the container. Four rectangular lugs adjacent the circumferential wall of the boss and spaced apart circumferentially at ninety-degree intervals project axially outwards along the cylindrical wall of the boss, but not as far as the disc-shaped outer transverse wall of the boss. The lugs are adapted to engage complementary slots in the outer annular wall of a tubular shotgun choke, while the boss serves as a pilot bushing, facilitating insertion of the lugs into proper registration with the slots. With lugs engaged with slots, the outer body of the container may be turned by hand to loosen or tighten the shotgun choke within the threaded bore of the gun barrel.

BRIEF SUMMARY OF THE DRAWINGS

FIG. 4 is an exploded elevation view of a modification of the device shown in FIG. 2.

FIG. 5 is an assembled view of the device shown in FIG. 4.

FIG. 6 is a side elevation view of a second embodiment of the device of FIG. 1 adapted to hold two chokes.

FIG. 7 is a side elevation view of a third embodiment of the device of FIG. 1 adapted to hold three chokes.

DETAILED DESCRIPTION OF THE INVENTION

Figures 1, 1A, 2, 3:
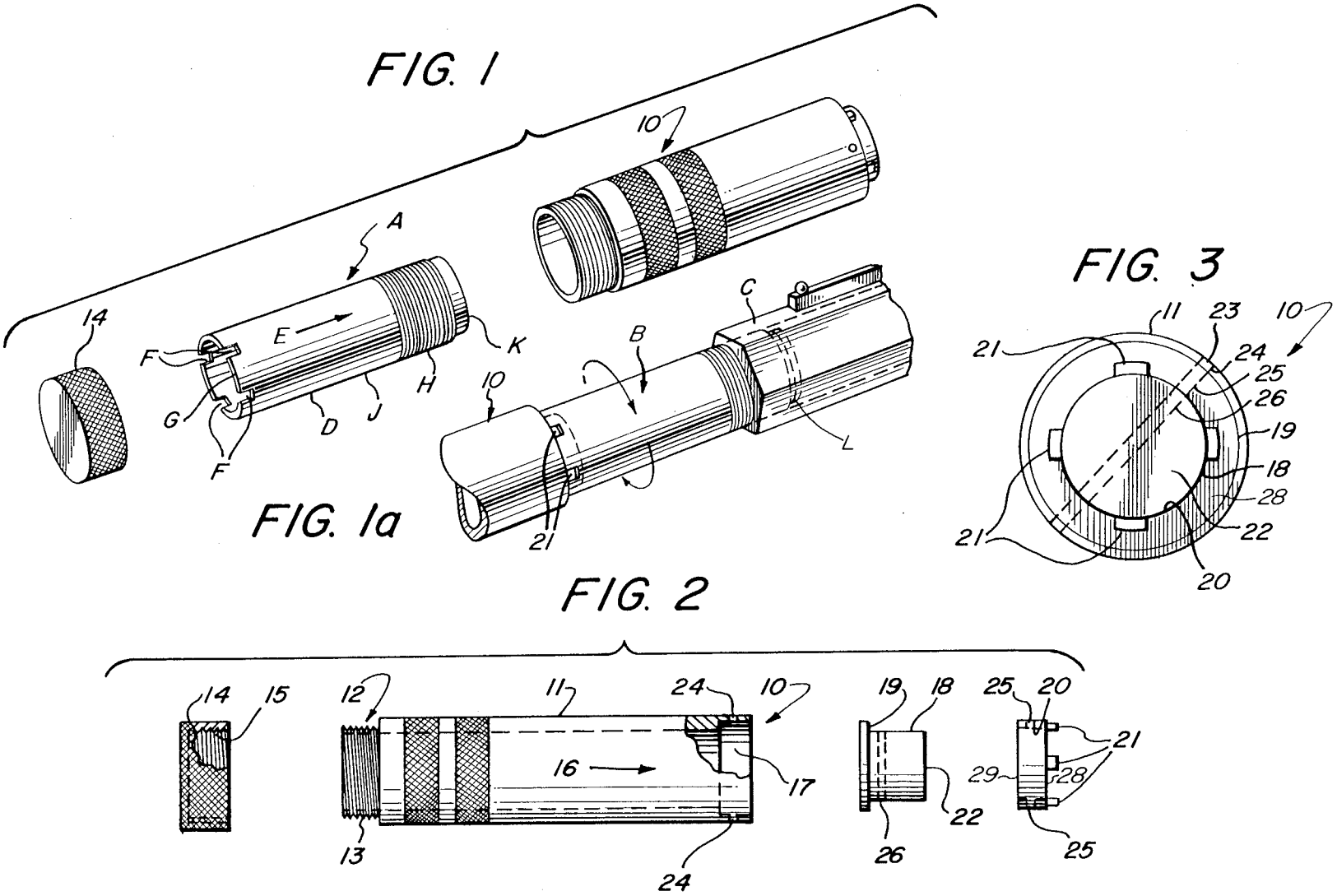
FIGS. 1 and 1*a* is a perspective view of one embodiment of the shotgun choke container/wrench according to the present invention, showing a choke which the device is intended to contain and torque, and showing a shotgun barrel muzzle in which a choke is being installed.
FIG. 2 is an exploded side elevation view of the device of FIG. 1.
FIG. 3 is a rear end elevation view of the device of FIG. 2.

Referring now to FIGS. 1 through 3, a shotgun choke container/wrench 10 according to the present invention is shown.

As shown in FIG. 1, the shotgun choke container wrench 10 is adapted to contain a tubular shotgun choke A, and to remove or istall that choke or a similar choke B into the muzzle bore of a shotgun barrel C. As shown in the Figure, the choke A or B consists of an elongated tube D having an inner cylindrical bore E which tapers to a slightly smaller diameter at the front end of the tube. Four rectangular slots F are cut longitudinally inwards from the front annular wall G of the tube D, and are spaced apart at 90-degree angles. Fine helical threads H are cut into the cylindrical wall surface J of the tube, beginning a slight distance inwards from the rear transverse wall K of the tube, and extending about one-third of the length of the tube forward. The shotgun barrel C is provided with internal helical threads L threadingly engageable with the threads H on tube D.

As may be seen best by referring to FIG. 2, the shotgun choke container/wrench 10 according to the present invention includes an elongated hollow cylindrical tube 11, preferably fabricated from aluminum tube stock. Tube 11 has a uniform outer diameter over nearly its entire length. However, the forward end of the tube 11 has a reduced diameter neck section 12 which extends longitudinally rearward about $\frac{3}{8}$ inch from the front transverse wall surface of the tube. The neck portion 12 has in its outer cylindrical surface helical threads 13.

Container/wrench 10 includes a concave cylindrical cap 14 provided with internal helical threads 15 adapted to threadingly engage the external helical threads 13 on the outer cylindrical wall surface of neck portion 12 of tube 11. Thus, cap 14 may be screwed on or off neck 12 to close or open the opening in tube 11 of container/wrench 10.

Referring again to FIGS. 2 and 3, it may be seen that tube 11 of container/wrench 10 has a uniform diameter bore 16 which extends the entire length of the tube. A larger diameter, coaxial counterbore 17 extends longitudinally inwards a short distance from the rear transverse wall of the tube 11. The counterbore 17 is adapted to insertingly receive a cylindrical plug or boss 18 having an enlarged diameter base flange 19 whose diameter is just slightly smaller than the inner diameter of counterbore 17.

The spanner wrench structure of container/wrench 10 includes a castellated cylindrical ring 20 made of a hard material such as steel. The castellated cylindrical ring 20 consists of a short, uniform diameter cylindrical tube having four rectangular elevation view and end-view lugs 21 formed in the cylindrical wall of the tube. The lugs 21 are relatively short and narrow.

As may be seen best by referring to FIG. 3, the lugs 21 are spaced apart at ninety-degree circumferential intervals around the periphery of castellated ring 20. As may be seen best by referring to FIG. 2, the four rectangular lugs 21 extend axially rearward from the rear annular wall of the castellated ring 20, the rear faces of the lugs lying in a common transverse annular plane parallel to the front transverse annular plane of the castellated ring 20.

The inner diameter of the castellated ring 20 is slightly larger than the outer diameter of cylindrical plug or boss 18, allowing the ring to be slipped coaxially over the plug in the assembly of the container/wrench 10, as shown in FIG. 1. The overall axial length of castellated ring from the front annular plane to the rear surfaces of the lugs 21, is approximately one-half the axial length of cylindrical plug or boss 18. Thus, when the castellated ring 20 is slid forward over the outer cylindrical surface of plug 18 until the front transverse annular face of the ring contacts the rear annular face of base flange 19 of the plug, the rear disc-shaped face 22 of plug 18 lies in a plane axially rearward some distance from the rear surfaces of the lugs 21.

As shown in FIGS. 1, 2 and 3, the castellated ring 20 and cylindrical plug 18 are secured to tube 11 by means of radially disposed pins 23 inserted radially inwards through registered holes 24, 25, and 26 through the cylindrical walls of the tube, ring, and plug, respectively.

FIGS. 4 and 5 illustrate an alternate embodiment of the shotgun choke container/wrench in which a castellated ring and plug are joined to the base of a container tube in a somewhat different fashion than described above for the basic embodiment.

In the alternate embodiment 10A of a shotgun choke container/wrench illustrated in FIGS. 4 and 5, the castellated ring 20A has a bevelled surface 27 joining the rear annular surface 28 to the outer cylindrical wall surface 29 of the ring. The bevelled surface 26 of castellated ring 20A contains a plurality of regularly and closely spaced fine, parallel, axially disposed grooves 30, which in combination make the bevelled surface knurled. The purpose of the knurled bevelled surface 27 of castellated ring 20A is to permit the ring and a cylindrical plug 18A to be attached to tube 11A without the requirement for auxiliary fastening members or holes in the elements to be fastened together. Thus, as shown in FIGS. 4 and 5, attachment of knurled castellated ring 20A and plug 18A to tube 11A is accomplished by slipping the ring axially over the plug, inserting plug and ring into counterbore 17A of tube 11A, and crimping that portion 31 of the cylindrical wall of tube 11A which overlies counterbore 17A, radially inwards against the knurled bevelled surface 27 of castellated ring 20A, as shown in FIG. 5.

The crimping action forces the castellated ring 20A, and base flange 19A of plug 18A into compression against the shoulder flange 32 at the bottom of counterbore 17A. This secures the castellated ring 20A and cylindrical plug 18A axially with respect to tube 11A. Also, the cold flow of the inner wall surface of rear aluminum cylindrical wall section 29 into the grooves 30 of steel castellated ring 20A secures the castellated ring from turning with respect to the tube 11A. This permits a substantial torque to be imparted via lugs 21A when tube 11A is twisted about its own axis.

FIGS. 6 and 7 show lengthened versions of container/wrench 10B and 10C adapted to hold 2 or 3 chokes end-to-end, respectively.

Each of the shotgun choke container/wrench 10, 10A, 10B and 10C described above is used in the identical fashion, as will now be described.

As shown in FIG. 1, the rearward protruding boss section 18 of the container/wrench 10 is of the proper size to fit snugly within the bore E of a shotgun choke A. Thus, boss 18 serves as a pilot bushing or guide to aid positioning container/wrench 10 coaxially with respect to the bore E of a choke 10. Thus positioned, container/wrench 10 is easily pushed axially into bore E of choke 10 sufficiently far for lugs 21 protruding rearward from castellated ring 20 to engage rectangular slots F in the front annular end wall G of the choke. The choke may then be screwed into or out of the shotgun barrel with ease.

From the description above, it is apparent that the novel shotgun choke container/wrench according to the present invention provides a highly effective means for carrying and protecting from damage interchangeable shotgun chokes, while also providing a very effective and conveniently available and useable means for installing and removing interchangeable shotgun chokes. These desirable features are all provided by the novel implement which can be carried in the pocket of the sportsman.

What is claimed is:

1. An implement for containing, transporting, installing and removing tubular shotgun chokes of the type having a plurality of slots cut longitudinally into the front transverse annular end wall thereof for engagement by the protruding lugs of a spanner-type wrench comprising:

(a) an elongated hollow cylindrical tube having at its front end a removable closure cap, the hollow cylindrical interior space of said tube being adapted to coaxially receive at least one of said tubular chokes;

(b) a cylindrical boss of smaller diameter than the outer diameter of said tube protruding axially rearward from the read end of said tube, in coaxial alignment with said tube, and (c) at least one pair of diametrically oppositely positioned lugs protruding axially rearward from the rear end of said tube, said lugs being of the proper size and diametric spacing to engage said slots of said choke.

2. The implement of claim 1 wherein said lugs are formed in a castellated cylindrical ring which coaxially overlies said boss, said lugs being formed by circumferentially spaced slots cut axially forward from the rear transverse annular wall of said ring.

3. The implement of claim 2 wherein said boss has a thin, circular base flange of larger diameter than the cylindrical body of said boss formed coaxially in the front transverse face of said body.

4. The implement of claim 3 wherein the rear opening of said hollow cylindrical tube is counterbored a short distance forward to terminate in an annular shoulder flange, the diameter of said counterbore being just slightly larger than the outer diameter of said base flange of said boss, whereby said boss may be inverted forward into said counterbore until the forward surface of said base flange seats on said annular shoulder flange.

5. The implement of claim 4 wherein the inner diameter of said castellated ring is just slightly larger than the outer diameter of said cylindrical body of said boss, and the outer diameter of said castellated ring is less than the outer diameter of said base flange of said boss, whereby said ring may slide forward over said boss until the forward annular transverse wall of said castellated ring seats against the rear surface of said base flange of said boss.

6. The implement of claim 5 wherein said castellated ring and said boss are fixedly attached to said tube by means of a radially disposed pin frictional fitting in registered radially disposed holes provided through said tube, said ring, and said boss.

7. The implement of claim 6 wherein said cylindrical boss has a rear disc-shaped wall located rearward of the rear faces of said lugs.

8. The implement of claim 5 wherein the rear portion of said castellated ring containing said slots has a smaller diameter than the forward portion of said ring, said rearward portion of said castellated ring being joined to the front portion thereof by an annular outwardly tapered transition section, said annular transition section having in its outer wall surface a plurality of regularly spaced fine, axially disposed grooves forming a knurled surface.

9. The implement of claim 8 wherein said castellated ring and said boss are fixedly attached to said hollow cylindrical tube by means of a crimping interface between the inner cylindrical wall surface of said counterbored rear portion of said hollow cylindrical tube and said knurled annular surface of said castellated ring.

10. The implement of claim 9 wherein said cylindrical boss has a rear disc-shaped wall located rearward of the rear faces of said lugs.

* * * * *